United States Patent [19]

Cohen

[11] 4,308,953

[45] Jan. 5, 1982

[54] ELECTRICALLY CONDUCTIVE CONTAINER

[75] Inventor: Joel B. Cohen, Wynnewood, Pa.

[73] Assignee: Shell Container Systems, Springfield, N.J.

[21] Appl. No.: 122,814

[22] Filed: Feb. 20, 1980

[51] Int. Cl.[3] ..... B65D 73/02

[52] U.S. Cl. ..... 206/334; 361/415; 339/17 C; 220/21

[58] Field of Search ..... 206/334, 328, 329, 332; 220/21; 361/415; 339/17 C, 17 M, 17 LM

[56] References Cited

U.S. PATENT DOCUMENTS

| | | | |
|---|---|---|---|
| 1,504,292 | 8/1924 | Wickes . | |
| 2,979,250 | 4/1961 | Hobbs . | |
| 3,069,598 | 12/1962 | Daily et al. | 339/17 LM |
| 3,554,429 | 1/1971 | Cohen | 206/334 |
| 3,627,140 | 12/1971 | Yanikoski | 361/415 |
| 3,774,757 | 11/1973 | Harris et al. . | |
| 4,037,267 | 7/1977 | Kisor . | |
| 4,038,693 | 7/1977 | Huffine et al. . | |
| 4,099,623 | 7/1978 | Van Osdol | 361/415 |
| 4,143,763 | 3/1979 | Haglund | 206/334 |
| 4,155,447 | 5/1979 | Edwards | 206/334 |
| 4,160,503 | 7/1979 | Ohlbach . | |
| 4,211,324 | 7/1980 | Ohlbach . | |
| 4,214,292 | 7/1980 | Johnson | 361/415 |
| 4,261,465 | 4/1981 | Thomas | 206/334 |

FOREIGN PATENT DOCUMENTS

| | | |
|---|---|---|
| 775042 | 1/1968 | Canada . |
| 2753258 | 6/1978 | Fed. Rep. of Germany . |
| 1321584 | 2/1963 | France . |
| 6504232 | 5/1964 | Netherlands . |

OTHER PUBLICATIONS

Article entitled "Electrically Conductive Fillers and Reinforcements," Plastics Compounding, Jan. & Feb., 1980.

Article entitled "Switch to Conductive Polyolefin PCB Racks Eliminates CMOS/FET Failures Due to Static Electricity," Insulation Circuits, Jan., 1977.

*Primary Examiner*—Joseph Man-Fu Moy

*Attorney, Agent, or Firm*—Lerner, David, Littenberg & Samuel

[57] ABSTRACT

An improved electrically conductive container for material handling, shipping and storing rigid planar objects, in particular such objects which have static sensitive devices thereon, and even as a production and in the manufacture of such objects. The electrically conductive container includes a cardboard container member formed from a substantially flat blank of cardboard material having electrically conductive material on the opposite sides thereof with the blank of cardboard material being cut and folded to define sidewalls and a bottom wall of the container member so that the interior surfaces of the cardboard container member are in electrical contact with the exterior surfaces of the cardboard container member. Electrically conductive holding panels having a plurality of slots therein are arranged on the interior sidewall surfaces of the cardboard container member in a manner to provide oppositely disposed slots which cooperate to form a plurality of holding pockets for positively receiving and holding the objects having static sensitive devices in the interior of the cardboard container member. The electrically conductive holding panels are in electrical contact with the interior sidewall surfaces. In this manner, the static sensitive devices on the objects placed in the container will be at the same potential as the container so that when the container is electrically grounded on a portion of the exterior surface thereof, it provides a vehicle to facilitate continuous gradual bleed-off of static charge so as to prevent blow-outs or other damage to the static sensitive devices as a result of a discharge of accumulated static charge.

21 Claims, 7 Drawing Figures

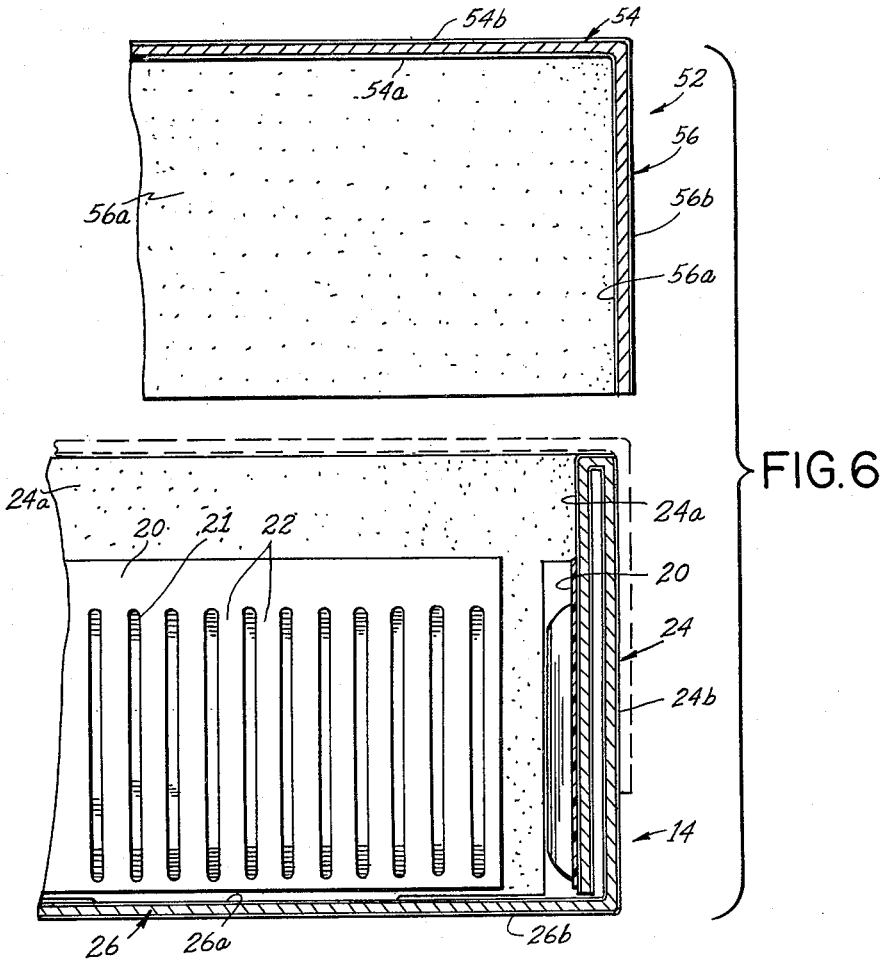
FIG.6
FIG.7
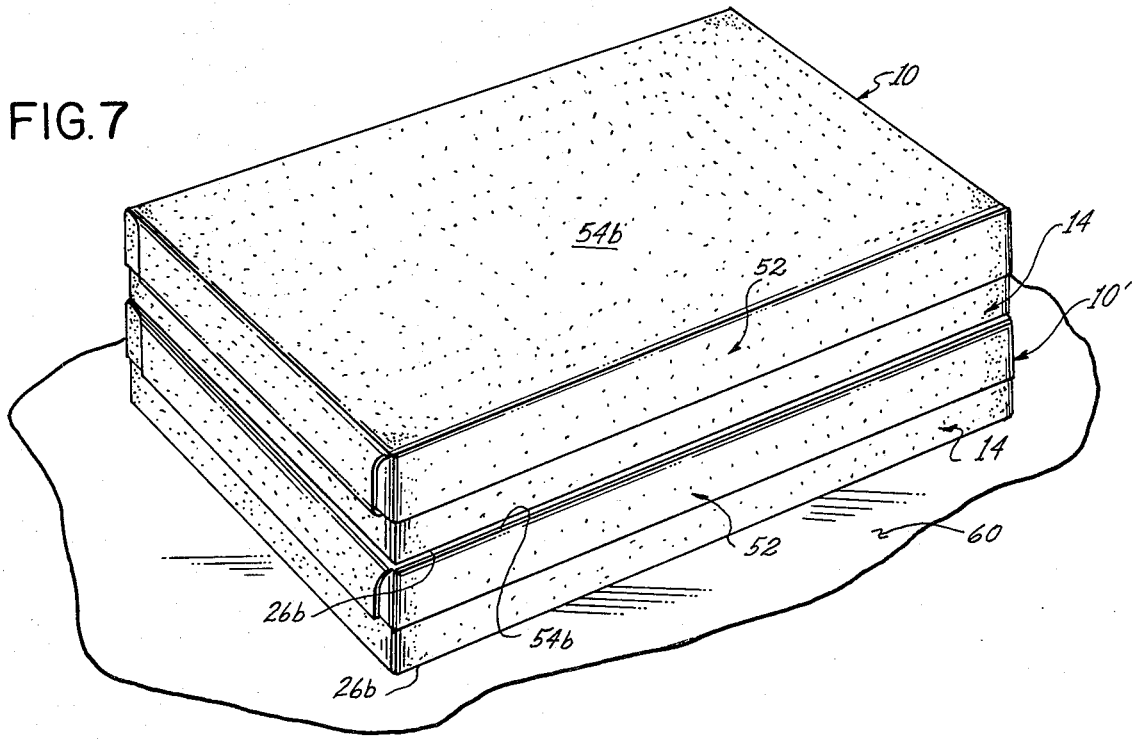

ELECTRICALLY CONDUCTIVE CONTAINER

BACKGROUND OF THE INVENTION

The present invention relates generally to containers for material handling, shipping and storing rigid, planar objects, and which may also be used as a production and in the manufacture of such objects. More particularly, the present invention is directed to an improved electrically conductive container for grounding circuit boards and the like having static sensitive devices on such planar objects, such as for example devices which have metal oxide semi-conductors.

Containers for circuit boards or other objects having static sensitive devices are known in the art. For example, in one arrangement, a container box is employed which is formed completely of conductive plastic material so that the entire container is conductive. In this arrangement, the container is molded entirely from plastic material and is provided with outer side walls and interior walls which together define a plurality of individual compartments for loosely receiving static sensitive devices as well as other types of devices, and for storing or housing same during non-use. However, because the devices to be stored are only loosely received in the compartments (i.e., they are not positively held in place), it is possible that the devices might pick up a static charge, the discharge of which might damage or possibly destroy the device entirely, such as by a blow-out or the like. Furthermore, although such containers may in some instances be satisfactory in minimizing the chances of static build up, the containers are relatively quite expensive to manufacture, since the entire container must be formed of conductive plastic material and since the entire container is molded.

In another prior art arrangement, a cardboard container is employed, and is provided on its interior walls with anti-static plastic members. This anti-static plastic members are slotted with ribs for receiving the static sensitive devices. However, the problem with such arrangements is that they are not electrically conductive but are merely anti-static. This difference is significant, since it has been found that anti-static members cannot not always be relied on to be electrically conductive, especially on dry days, since the anti-static members appear to require moisture in order to operate to some extent and be conductive so as to prevent static build up.

In a still further arrangement of the prior art, a cardboard shipping container or box is employed which is provided with an electrically conductive coating sprayed on the entire interior of the box. Such containers are mainly used for shipping of printed circuit boards and the like by wrapping the printed circuit boards in a static free plastic cushioning, and then inserting the packaged circuit board into the box. In some instances, the containers may include suitable conductive partitions therein for use in shipping a plurality of printed circuit boards. Again, however, even with the multiple partitioning type of arrangement, no means are provided for positively holding and retaining in place the circuit boards having static sensitive devices thereon and for ensuring suitable grounding of the devices with respect to their environment since there is no assurance that the circuit boards and the static sensitive devices are in contact with the electrically conductive coating on the interior of the box and since no means are provided for grounding the interior of the box with respect to its environment. This is particularly true when the printed circuit board is wrapped with a static-free cushioning material.

Accordingly, it is highly desirable to provide an arrangement which is capable of positively receiving and holding rigid planar objects, in particular objects having static sensitive devices, in a manner to ensure against, or at least minimize the possibly of static build up while at the same time accomplishing such purpose in a relatively inexpensive manner. In this regard, it is also highly desirable to provide a container which is electrically conductive at all times, and further, is less costly to manufacture as compared to containers which are entirely electrically conductive as described above. Still further, it is desirable to provide a container which positively holds and receives rigid planar objects having static sensitive devices thereon, and which also provides a simple, efficient and inexpensive manner of grounding of the container and circuit boards and the like which contain static sensitive devices.

SUMMARY OF THE INVENTION

In accordance with the present invention, there is provided an improved electrically conductive container for storing rigid planar objects, such as for example those containing static sensitive devices, which overcomes the above noted disadvantages of the prior art. More particularly, the electrically conductive container in accordance with the present invention comprises a container member having an interior wall surface defining an interior of the container member and an exterior wall surface. Electrically conductive holding panels having a plurality of slots therein are arranged on the interior wall surface of the container member in a manner to provide oppositely disposed slots which cooperate to form a plurality of holding pockets for positively receiving and holding the rigid planar objects in the interior of the container member. A portion of the exterior wall surface of the container member is electrically conductive, and electricaiiy conductive means are provided for electrically connecting the electrically conductive holding panels to the exterior electrically conductive portion of the container member.

In this manner, planar objects held in place in the container by means of the slots of the electrically conductive holding panels will be in electrical contact with the exterior electrically conductive portion of the container member which in turn may be suitably grounded with respect to the environment in which the electrically conductive container is disposed, thereby ensuring a simple, efficient and inexpensive manner of grounding the electrically conductive container as well as any static sensitive devices stored therein. That is, the electrically conductive container may be electrically grounded so that the rigid planar objects having static sensitive devices are grounded and are at the same potential as the environment surrounding the container so as to prevent blow-outs or other damage to the static sensitive devices as a result of a discharge of static build up therethrough. Specifically, when the electrically conductive container of the present invention is supported on a grounded surface with the exterior electrically conductive portion in electrical contact with the grounded surface, the container and any static sensitive devices will automatically be grounded. This will provide a continuous gradual bleed-off of any accumulated static build up, thereby avoiding any damage which might otherwise result when an accumulation of static charge is suddenly discharged.

In accordance with the preferred embodiment of the present invention, the container member is formed from a substantially flat blank of cardboard material having electrically conductive material on the opposite sides thereof with the blank of cardboard material being cut and folded to define sidewalls and a bottom wall of the container in which the interior surfaces of the container member are in electrical contact with the exterior surfaces of the container member. In this manner, the container member may be simply and easily grounded by simply placing the container on a suitable grounded surface. Also in accordance with the preferred embodiment, there is provided an electrically conductive cover member which includes an electrically conductive material on at least one surface thereof so that a substantially closed interior of the cardboard container member is provided and which is surrounded with electrically conductive material. This arrangement in effect provides a Faraday type shield or screen for preventing any electrical static build up within the interior of the cardboard container member.

Further, the provision of the entire exterior surfaces of the container member having an electrically conductive material adhered thereto is most advantageous in permitting a plurality of such electrically conductive containers to be stacked one on top of the other and with one of the containers being in electrical contact with a suitable grounding surface. In this manner, each of the containers in the stack will be grounded by virtue of each of the containers being in electrical contact with one another and with the container in contact with the grounded surface.

These and further features and characteristics of the present invention will be apparent from the following detailed description in which reference is made to the enclosed drawings which illustrate a preferred embodiment of the present invention.

BRIEF DESCRIPTION OF THE DRAWINGS

FIG. 6 is a cross-sectional view illustrating the manner in which the cover member is electrically connected to the cardboard container member.

FIG. 7 is a perspective view illustrating a plurality of electrically conductive containers in accordance with the present invention being stacked one on top of the other.

DETAILED DESCRIPTION OF THE PREFERRED EMBODIMENT

Figure 1:
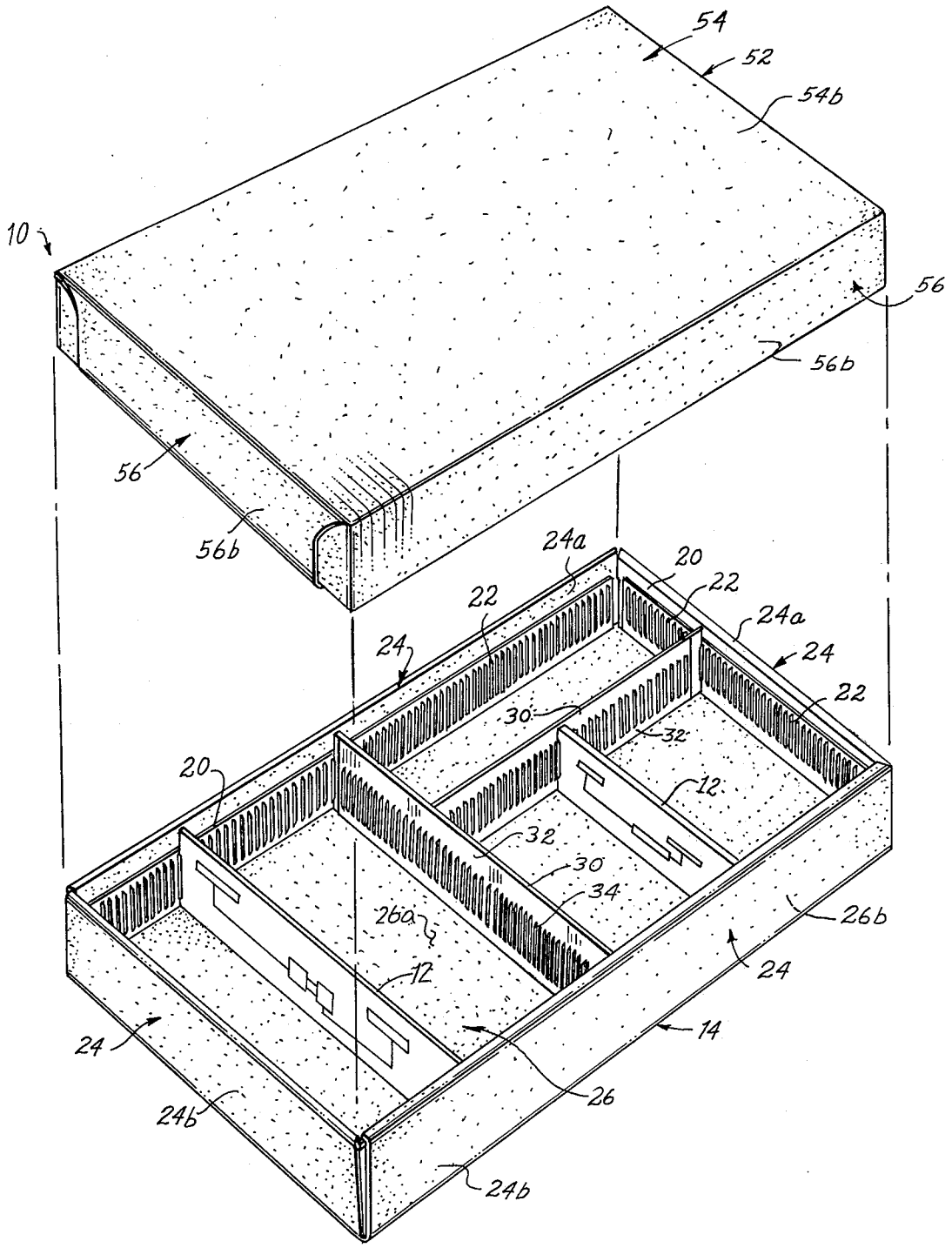
FIG. 1 is an exploded perspective view of an electrically conductive container in accordance with the present invention.

Referring now to the drawings wherein like reference characters represent like elements, there is shown in FIG. 1 an electrically conductive container 10 in accordance with the present invention in which rigid substantially planar objects 12 may be stored. Such objects 12 for example may comprise printed circuit boards or the like which have metal oxide semi-conductors therein. As is well known, metal oxide semi-conductors or other metal oxide containing devices are extremely sensitive to static electricity or charge. Specifically, such devices, if subjected to discharging of even the smallest accumulation of static charge might be damaged or completely destroyed as for example by a blow-out or the like. Such devices are generally referred to as static sensitive devices.

In the manufacture of such objects containing static sensitive devices, virtually the entire manufacturing facilities and equipment which is used are suitably grounded to prevent or minimize any build up of static charge. For example, the tables or work areas themselves are grounded as well as the workers and workers' tools so that any static build up which might otherwise occur is immediately discharged through the grounding. Furthermore, it will be appreciated that during shipping and storage of such objects 12 after their manufacture, it is equally important that static build up be prevented in the surroundingenvironment or in contact with the static sensitive devices 12 in order to prevent or at least minimize the chances of such objects 12 being subjected to a discharge of accumulated static charge. It is to this end that the electrically conductive container 10 of the present invention is directed. More particularly, the electrically conductive container 10 in accordance with the present invention is designed for use in preventing or at least minimizing the possibility of any static build up by continuously and gradually bleeding-off any electrical charge directly to a suitable ground in a simple, efficient and inexpensive manner so that any objects containing static sensitive devices stored in the container 10 will not be subjected to any substantial discharge of accumulated static charge.

Referring to FIG. 1, the electrically conductive container 10 in accordance with the present invention comprises a container member or box structure 14 having an interior wall surface **24*a*, 26*a* defining an interior of the box 14 and also having an exterior wall surface 24*b*, 26*b*. In the interior of the box 14 there is provided electrically conductive holding panels 20 which are arranged on the interior wall surface 24*a* of the box 14 to provide oppositely disposed slots 22 which cooperate with one another to form a plurality of holding pockets for positively receiving and holding rigid planar devices, such as for example static sensitive devices 12. The holding panels 20 themselves are electrically conductive and are in electrical contact with an electrically conductive portion on the exterior wall surface 24*b*, 26*b* of the box 14 so that when the exterior electrically conductive portion of the box 14 is grounded, the holding panels 20, as well as any objects 12 in electrical contact therewith, will themselves also be grounded. In the preferred embodiment, substantially the interior wall surface 24*a*, 26*a* and the entire exterior wall surface 24*b*, 26*b* of the box 14 are electrically conductive, and are in electrical contact with one another and with the electrically conductive holding panels 20**.

More particularly, the container member or box 14 includes a plurality of upstanding sidewalls 24 and a bottom wall 26 which are all interconnected to one another in a conventional manner to form the container box 14. The inner wall surface 24*a*, 26*a* of the side and bottom walls 24, 26 together define the interior wall surface of the box 14 and the exterior or outer wall surfaces 24*b*, 26*b* of the side and bottom walls 24, 26 together define the exterior wall surface of the box 14. Both the interior and exterior wall surfaces 24*a*, 26*a*, 24*b*, 26*b*, of the box 14 are provided with electrically conductive material thereon.

In this regard, the box 14 in the preferred embodiment is comprised of a non-conductive material which has electrically conductive material adhered to the surfaces thereof. More particularly, in the preferred embodiment, the box 14 is formed from a suitable blank 28 of corrugated cardboard material (see FIGS. 2 and 3) which has an electrically conductive coating or material, such as for example carbon black or graphite impregnated paper, laminated to the surfaces 28*a* and 28*b* of the blank 28. However, it should be appreciated that any suitable material may be used for the box 14, so long as the surfaces (or a portion thereof) are electrically conductive. For example, corrugated cardboard material or solid cardboard material or even plastic sheets which are capable of being cut and folded, or partially cut and folded, could be utilized which can then be coated, lined or laminated with an electrically conductive material. Still further, a non-conductive material could be used which is impregnated with electrically conductive material so as to be entirely conductive and in particular to provide electrically conductive surfaces or portions. However, in the preferred embodiment, corrugated cardboard material is utilized which has an electrically conductive paper sheet or layer adhered thereto in order to make an acceptable, yet relatively inexpensive, electrically conductive container member or box 14.

Adhered to each of the inner sidewall surfaces 24*a* of the box 14 is a slotted holding panel 20 having a plurality of spaced ribs 21 defining therebetween spaced apart holding slots 22. The spaced apart holding slots 22 cooperate with oppositely disposed slots 22 on an oppositely disposed holding panel 20 to form pockets for receiving opposite edge portions of rigid substantially planar objects, for example printed circuit boards 12, and the like (see FIGS. 1 and 4). Specifically, the printed circuit boards 12 and the like are designed to be inserted in oppositely disposed slots 22 of the holding panels 20 to be rigidly and positively firmly held in place within the interior of the box 14. Such slotted holding members themselves are known in the prior art, for example as disclosed in U.S. Pat. No. 3,554,429, and may be made from a suitable plastic material capable of molding to form the slotted configuration for the holding panels.

However, in accordance with the present invention, the slotted holding panels 20 are electrically conductive so as to be capable of conducting an electrical charge. For example, in order to make the holding panels 20 electrically conductive, any suitable electrically conductive material may be mixed with a plastic material suitable for molding, such as by thermo forming, and the mixed plastic and electrically conductive material molded in the desired shape or configuration. In the preferred embodiment, a conductive material such as carbon black or graphite material is mixed with the plastic material to provide carbon black or graphite impregnated plastic material from which the holding panels 20 are formed so as to be electrically conductive. The electrically conductive slotted holding panels 20 may then be adhered to the inner wall surfaces 24*a* of the container box 14 in any suitable manner so as to make electrical contact therewith, such as for example with any suitable adhesive, glue, staples or the like.

Therefore, it will be appreciated that in accordance with the present invention, the printed circuit boards 12 or the like when positioned and held in the slots 22 of the holding panels 20, will be in electrical contact with the holding panels 20 themselves which in turn, by virtue of the electrical connection between the holding panels 20 and the electrically conductive surface 24*a* of the sidewalls 24 of the container box 14, and the electrical interconnection of the interior surfaces 24*a* and the exterior conductive surface 24*b*, 26*b*, of the container box 14, will be at the same electrical potential as the exterior of the box 14. In this manner, by simply grounding the exterior surface 24*b*, 26*b* of the container box 14, the inner wall surfaces 24*a*, 26*a* of the container box 14, and the holding panels 20, as well as the circuit boards 12 and static sensitive devices thereon, will also be electrically grounded to prevent any substantial accumulation of build up or static charge.

Figure 4:
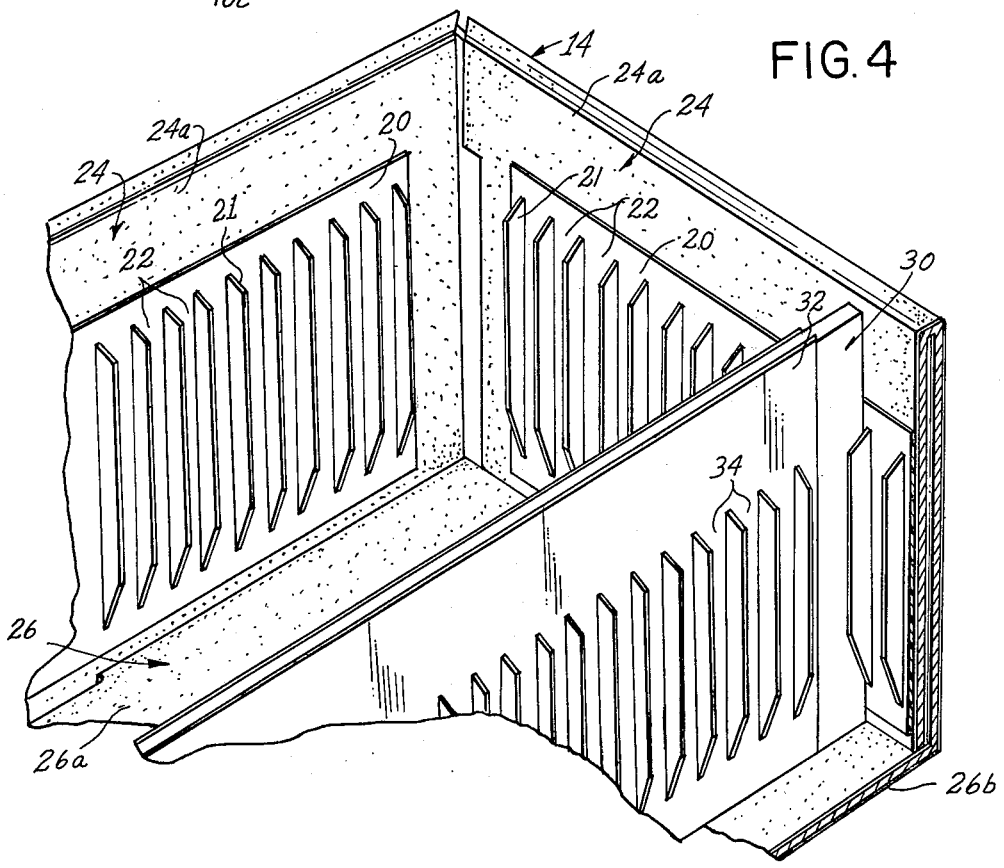
FIG. 4 is an enlarged perspective view, partly in section, illustrating a portion of the interior of the electrically conductive container in accordance with the present invention.

The slotted holding panels 20 may also be adapted to receive electrically conductive slotted divider walls 30 which are also provided with slots 34 for cooperating with oppositely disposed slots 22 in oppositely disposed holding panels 20 to form additional pockets for receiving rigid substantially planar devices 12, such as for example planar objects containing static sensitive devices like printed circuit boards and the like (see FIGS. 1 and 4). In this instance, the divider wall 30 may be formed of a suitable plastic material having electrically conductive material mixed therewith or of other material which is electrically conductive and having a slotted holding panel 32 in electrical contact therewith. For example, if a cardboard or non-conductive material is utilized for the divider wall 30, a suitable electrically conductive coating or material could be provided on the external surfaces thereof so that the holding panels 32 thereof will be in electrical conductive contact with the divider wall 30. Alternatively, as in the preferred embodiment, the holding panels 32 could extend slightly beyond the lower end of the divider wall 30, which is non-conductive, so as to be in electrical contact with the interior electrically conductive bottom wall surface 26*a* to complete the desired elecrical contact (see FIG. 4). In either event, (i.e., if the divider wall 30 is electrically conductive and received in oppositely disposed slots 22 of the electrically conductive holding panels 20 on the sidewalls 24 of the box 14 or if the holding panels 32 contact the bottom wall surface 26*a*, the holding panels 32 of the divider wall 30 will be in electrical contact with the remainder of the box 14. In this manner, it will be appreciated that the entire components and surfaces provided in the interior and on the exterior of the electrically conductive container 10 are all electrically connected together.

Figure 2:
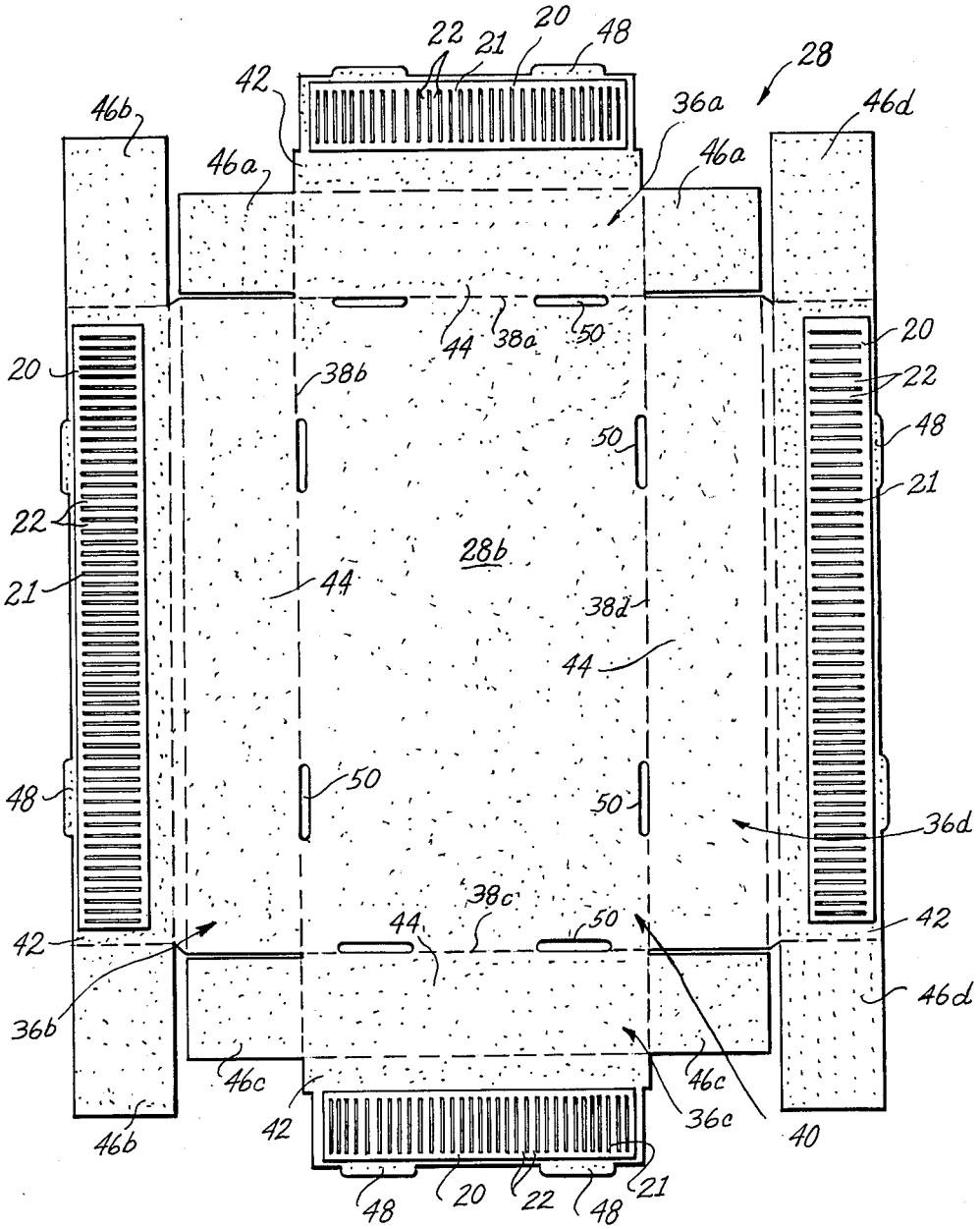
FIG. 2 is a plan view of the blank from which the electrically conductive cardboard container member is formed, in accordance with the present invention.
Figure 3:
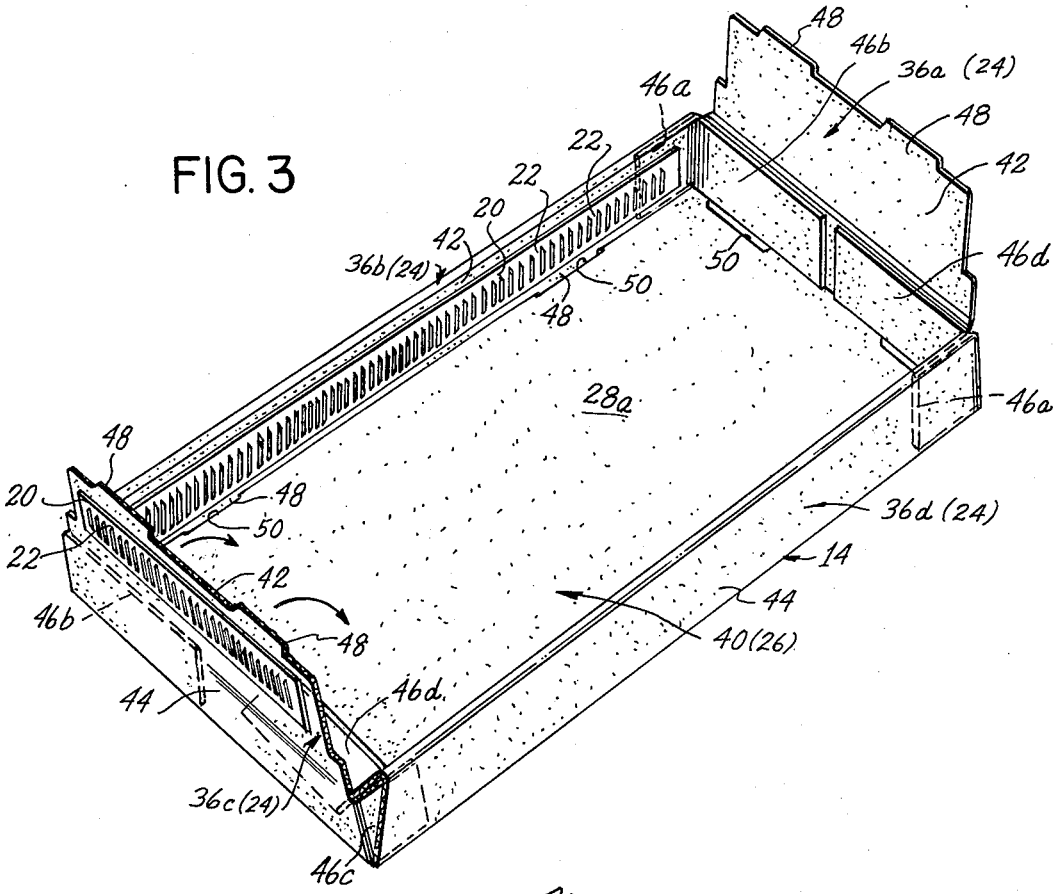
FIG. 3 is a perspective view illustrating how the blank of material shown in FIG. 2 may be folded to form electrically conductive cardboard container member in accordance with the present invention.

In the preferred embodiment, the container box 14 is formed from a suitable blank 28 of cardboard material which is provided with electrically conductive material adhered on the opposite sides thereof (see FIG. 2). For example, in the preferred embodiment, this electrically conductive material may comprise graphite impregnated paper which is laminated to the opposite sides 28*a*, 28*b* of the blank 28 from which the container box 14 is formed (only the side 28*b* is shown in FIG. 2). Suitable cuts may be provided in the blank 28. More particularly, in the preferred embodiment, the blank 28of cardboard material is cut to define four side sections 36*a–d* extending away from four fold lines 38*a–d* defining a bottom wall section 40. Each of the side sections 36*a–d* is comprised of first and second portions 42, 44 adapted to be folded one over another to define the sidewalls 24 of the container box 14. The holding panels 20 are secured in electrical contact with the first portions 42 on the second side 28*b* of the blank 28 (FIG. 2). Also, the blank 28 is provided with folding flap sections 46*a–d* at the ends of each of the side sections 36*a–d* which serve to interlock the sidewalls 24 together. More particularly, as best seen in FIG. 3, the container box 14 is constructed by folding upwardly to be substantially perpendicular to the bottom wall section 40 a pair of oppositely disposed side sections 36*a*, 36*c* with the folding flap members 46*a*, 46*c* being folded at right angles thereto. Next, the other pair of oppositely disposed side sections 36*b*, 36*d* are folded upwardly, and then the first portions 42 thereof folded downwardly so that the folding flap members 46*a*, 46*c* of the side sections 36*a*, 36*c* are received between the first and second portions 42, 44 of each of the side sections 36*b*, 36*d*. The blank 28 may also be provided with openings 48 cut therein along the fold lines 38*b*, 38*d* for receiving tabs 50 at the ends of the first portion 42 to hold the pair of side sections 36*b*, 36*d* upright. The folding flaps 46*b*, 46*d* of the side sections 36*b*, 36*d* are then folded to be positioned against the second portions 44 of the other pair of side sections 36*a*, 36*c*, and the first portions 42 of the side sections 36*a*, 36*c* folded downwardly to hold the folding flaps 46*b*, 46*d* in place. Again, suitable openings 48 in the fold lines 38*a*, 38*c* and tab members 50 on the side sections 36*a*, 36*c* may be provided to lock the side sections 36*a*, 36*c* in an upright position.

Accordingly, it will be appreciated that the interior wall surface 26*a* of the bottom wall 26 is defined on the first side 28*a* of the blank 28, and the interior and exterior wall surfaces 24*a*, 24*b* of the sides 24 and the exterior surface 26*b* of the bottom wall 26 are defined on the second or opposite side 28*b* of the blank 28. By virtue of the graphite impregnated paper laminated to the second side 28*b* of the blank 28, the inner and outer surfaces 24*a*, 24*b* of each of the sidewalls 24 are in electrical contact with one another since the graphite impregnated paper is continuous on the second surface 28*b* of the blank 28. Further, the first surface 28*a* of the blank 28 will be in electrical contact with the second surface of the blank 28 since the portions of the folding flaps 46*a–d* defined in the second surface 28*b* of the blank 28 (i.e., the side 28*b* on which the holding panels 20 are provided) are in electrical contact with portions of the first surface 28*a* of the blank 28 (i.e., between the first and second portions 42, 44 of the side sections 36*a–d*). Thus, the interior wall surface 26*a* of the bottom wall 26 is in electrical contact and at the same potential as the interior and exterior wall surfaces 24*a*, 24*b* of the sidewalls 24. Also, the holding panels 20 secured in electrical contact with the first portion 42 of each of the upright sidewall sections 36*a–d* will be at the same electrical potential as the remainder of the box 14.

Such an arrangement provides a convenient means for forming a substantially strong, rigid container or box 14 having a double wall thickness. At the same time by virtue of the graphite impregnated paper laminated to the opposite sides 28*a*, 28*b* of the blank 28 from which the container box 14 is formed, each of the interior wall surfaces 24*a* of the sides 24 of the container box 14 are in electrical contact with one another and with the exterior surfaces 24*b* of the sides 24 of the container box 14. Additionally, the interior and exterior surfaces 26*a*, 26*b* of the bottom wall 26 are in electrical contact therewith by virtue of the folding flaps 46*a–d* providing electrical contact between portions of two sides 28*a*, 28*b* of the blank 28. Furthermore, any planar objects 12 engaged and held in place in the holding pockets defined by the oppositely disposed slots 22 of the holding panels 20 will be electrically interconnected with the box 14 and will be at the same electrical potential as the box 14. Of course, it should be realized that this arrangement for a blank 28 and folding of same is only one example of an electrically conductive box 14, and that the examples described above could be used with respect to virtually any type of foldable blank member to form an electrically conductive box.

Therefore, in accordance with the present invention, the entire container box 14 and its contents are at the same electrical potential and may be electrically connected to a suitable ground potential outside the container box 14. This grounding may be accomplished by simply placing the container box 14 on any electrically conductive surface or electrically conductive table which is connected to ground potential. This grounding will include the holding panels 20 as well as the bottom panel 26, and further will include any holding panels 32 on the divider walls 30 and any objects 12 being held therein. Therefore, it will be appreciated that static charge will not be able to build up in the container box 14, but rather will be bled off substantially instantaneous or simultaneously as it would otherwise tend to build up. This will serve to protect any objects 12 having static sensitive devices which are stored within the container box 14 from discharge of accumulated static charge and will in particular, protect metal oxide type semi-conductors which may be provided on the objects 12 stored in the container box 14.

Figure 5:
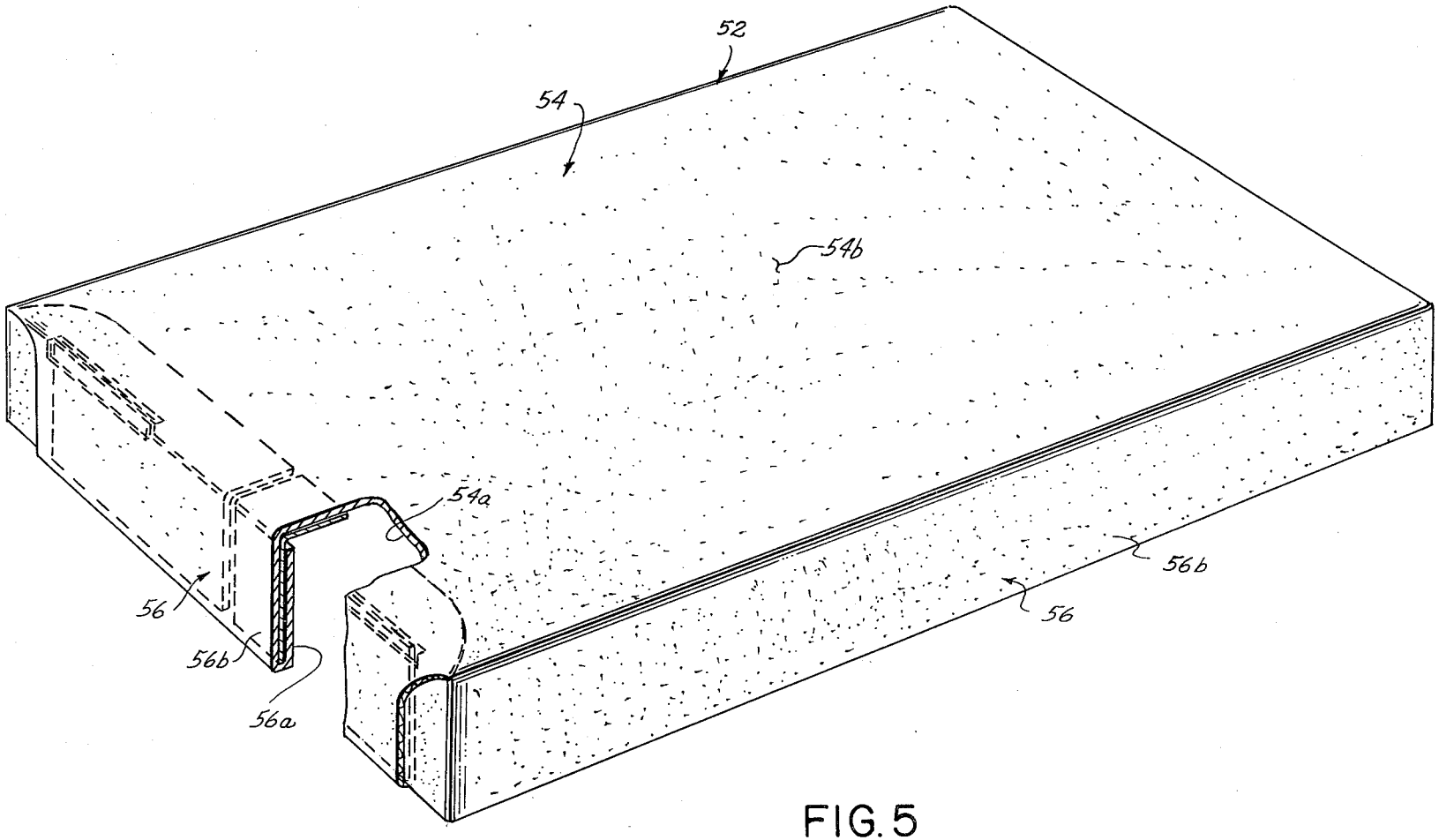
FIG. 5 is an enlarged perspective view, partly in section, illustrating the cover member for the cardboard container member in accordance with the present invention.

Referring now to FIGS. 1 and 5, it is to be noted that the electrically conductive container 10 also preferably includes a cover member 52 for closing the container box 14 to provide a substantially closed interior thereof. This cover member 52 is also preferably constructed of cardboard having graphite impregnated paper or other electrically conductive material adhered thereto on the opposite sides of the blank from which it is formed. The cover member 52 preferably includes an upper portion 54 and a plurality of depending wall portions 56 and may be constructed in a manner similar to that by which the container box 14 is constructed so that the interior surfaces 54*a*, 56*a* and the exterior surfaces 54*b*, 56*b* of the cover member 52 will be all electrically interconnected with one another. As best seen in FIG. 6, when the cover member 52 is placed on the container box 14, the interior surfaces 56*a* of the depending sidewalls 56 will engage the exterior surfaces 24*a* of the container box sidewalls 24 so that the cover member 52 and container box 14 will be electrically interconnected, and grounded if the container box 14 is placed on a suitable grounding surface.

This arrangement also provides an additional protection for static sensitive devices on objects 12 provided in the container 10 by virtue of the fact that the entire interior of the container 10 will be surrounded by an electrically conductive material which is at the same electrical potential. This will provide a Faraday shield or screen effect for the container 10 to ensure against static build up within the interior of the container 10, since both the interior surfaces 24*a*, 26*a*, 54*a* and exterior surfaces 24*b*, 26*b*, 54*b* of the container 10 will be electrically interconnected and will be at the same electrical potential. Additionally, this Faraday shield effect will insulate any static sensitive devices within the container 10 from electromagnetic fields in the surrounding environment which might otherwise damage the static sensitive devices.

Still further, in accordance with the present invention, a plurality of such containers 10 may be stacked one on top of the other so that each of the containers 10 will be at the same electrical potential and grounded if the bottom container 10' (or one of the other containers 10) is electrically connected to a suitable grounding source. This may be easily accomplished by simply placing the bottom container 10' of the stack on a suitable grounding surface, such as a table 60, as best seen in FIG. 7, in contact with the exterior surface 26*b* of the bottom container 10'. Then each of the other containers 10 of the stack will be similarly grounded by virtue of the electrical connection between each of the containers 10 through the exterior surfaces, (in particular the surfaces 26*b*, 54*b*) of the stacked containers 10. Thus, in this manner an entire stack of containers 10 and the static sensitive devices on objects 12 being held therein can be grounded and protected against blow out and the like.

It should be appreciated that the electrically conductive container 10 in accordance with the present invention, may be relatively inexpensively manufactured. For example, in accordance with the present invention, virtually any type of cardboard container may be employed by adhering electrically conductive material to the opposite surfaces of the cardboard blank from which it is constructed, and then cutting and folding the blank in a manner to provide electrical interconnection between the respective sides of the blank. For example, an electrically conductive paper such as graphite impregnated paper can be laminated to the blank of cardboard material. Alternatively, an electrically conductive coating could be sprayed onto the opposite sides of the cardboard blank. Still further, suitable plastic materials such as plastic sheets which are capable of being cut and folded or partially cut and folded could be used if coated, lined or impregnated with an electrically conductive material. The electrically conductive holding panels 20 may then be easily secured in place in electrical contact with the interior wall surface 24*a* of the sidewalls 24 of the box 14, either before or after construction of the box 14.

Further, it will be appreciated that when such a container box 14 is folded in this manner, it may be easily collapsed for storage during nonuse by simply unfolding of the various panels and sections, along the same principles as shown in the construction of the container box 14 described hereinabove. This is particularly advantageous wherein it is desired to conserve space in shipping of the electrically conductive containers 20 or during nonuse of the containers 10.

Although the container 10 in accordance with the present invention has been illustrated as being constructed from a blank 28 of cardboard material having electrically conductive material adhered to substantially the entire opposite surfaces 28*a*, 28*b* of the blank 28, it should also be appreciated that an electrically conductive container could be provided wherein only selected portions of the container box 14 have electrically conductive material adhered thereto. For example, foil or metallic tapes could be arranged along portions of the interior and exterior surfaces of the container box in a manner to provide electrical contact between selected portions of the inner and outer surfaces of the container and to electrically interconnect each of the holding panels 20 so that the static sensitive devices on the objects 12 will be at the same electrical potential as the holding panels 20 and as the exterior electrically conductive portion of the container. The electrically conductive portion of the tape on the exterior of the container box could then be suitably connected to a grounding potential to prevent discharge of any static build up through the static sensitive devices. Alternatively, or in addition, the electrically conductive holding panels 20 could be adhered to the inner surfaces of the container box and electrically interconnected to one another with the use of an electrically conductive foam bottom in the bottom of the container box which contacts each of the holding panels 20. The holding panels 20 could then be electrically connected with an exterior portion of the container box by means of foil tape which is in electrical contact with one or more of the holding panels 20 and/or the electrically conductive foam in the bottom of the box.

It will further be appreciated that in accordance with the present invention, each of the rigid substantially planar objects 12 (i.e., objects which have oppositely disposed holding portions for engagement in the slots 22 of the holding panels 20) will be rigidly and firmly held in place to ensure that they are at the same electrical potential as the holding panels 20 and the remaining electrically interconnected portions of the container box 14. Such an arrangement in which static sensitive devices on the objects 12 are firmly held in place thus will ensure against or at least minimize the possibility of discharge of any accumulated static charge through the static sensitive devices by providing a positive holding therefor which is electrically conductive and which may be grounded.

Accordingly, it will be appreciated that in accordance with the present invention there is provided an electrically conductive container 10 for rigid planar objects 12 which comprises a container box or member 14 having an interior wall surface 24*a*, 26*a* defining an interior of the container member 14 and an exterior wall surface 24*b*, 26*b*. Electrically conductive holding panels 20 having a plurality of holding slots 22 therein are arranged on the interior wall surface 24*a* of the container to provide oppositely disposed slots 22 which cooperate to form a plurality of holding pockets for positively receiving and holding the rigid planar objects 12 in the interior of the cardboard container member 14. The cardboard container member 14 is provided with an exterior electrically conductive portion thereon (i.e., the entire exterior surface 24*b*, 26*b* in the preferred embodiment), and electrically conductive means are provided for electrically connecting the holding panels 20 to the exterior electrically conductive portion of the cardboard container member 14.

In the preferred embodiment, the container member 14 is formed from a substantially flat blank 28 of cardboard material having electrically conductive material adhered to the opposite sides 28*a*, 26*a* thereof (for example, graphite impregnated paper laminated to the opposite sides 28*a*, 28*b* of the blank 28), the blank 28 of cardboard material being cut and folded to define sidewalls 24 and a bottom wall 26 of the container member 14 so that the interior and external surfaces 24*a*, 24*b* of the sidewalls 24 are electrically interconnected with one another. Further in the preferred embodiment, the blank 28 of cardboard material is cut and folded so that the interior and exterior surfaces 24*a*, 24*b* of the sidewalls 24 are both defined by first and second portions 42, 44 respectively on one of the sides 28*b* of the blank 28 of cardboard material having an electrically conductive material adhered thereto. The holding panels 20 are electrically connected to the electrically conductive material on the interior surface 24*a* of the container member 14 so that the means for providing electrical interconnection between the holding panels 20 and the exterior surface 24*b* of the container member 14 comprises the electrically conductive material intermediate the first and second portions 42, 44 on the one side 28*b* of the blank 28 of cardboard material.

Also in accordance with the present invention, a cover member 52 is provided which has electrically conductive material adhered thereto and which is arranged to be in electrical contact with the cardboard container member 14 so that the interior of the container member 14 is substantially surrounded by electrically conductive material at the same electrical potential.

While the preferred embodiment of the present invention has been shown and described, it will be understood that such is merely illustrative and that changes may be made without departing from the scope of the invention as claimed.

What is claimed is:

1. An electrically conductive container for rigid planar objects comprising:

a non-conductive container member made of a non-conductive material and having an interior wall surface defining an interior of said container member and an exterior wall surface;

electrically conductive holding panels having a plurality of slots therein, said holding panels being arranged on said interior wall surface of said container member to provide oppositely disposed slots which cooperate to form a plurality of holding pockets for positively receiving and holding said objects in said interior of said container member;

and exterior electrically conductive portion on said exterior wall surface of said container member; and electrically conductive means for electrically connecting said holding panels to said exterior electrically conductive portion of said container member.

2. The electrically conductive container of claim 1 wherein said container member has a bottom wall and a plurality of sidewalls connected to said bottom wall, said bottom wall and said sidewalls each including a first surface and a second surface, said first surfaces of said bottom wall and said sidewalls together comprising said interior wall surface of said container member and said second surfaces of said bottom wall and said sidewalls together defining said exterior wall surface of said container member; and wherein said electrically conductive holding panels are arranged on said first surfaces of said sidewalls.

3. The electrically conductive container of claim 2 wherein said electrically conductive holding panels are formed of a non-conductive material and include electrically conductive material to make said holding panels electrically conductive.

4. The electrically conductive container of claim 3 wherein said non-conductive material of said holding panels comprises a plastic material.

5. The electrically conductive container of claim 4 wherein said conductive material of said holding panels comprises carbon black material.

6. The electrically conductive container of claim 2 wherein said exterior electrically conductive portion of said container member comprises graphite material adhered to a portion of said exterior wall surface of said container member.

7. The electrically conductive container of claim 2 wherein said electrically conductive means comprises electrically conductive material adhered to said first surfaces of said sidewalls of said container member, and wherein said electrically conductive holding panels are in electrical contact with said electrically conductive material on said first surfaces of said sidewalls.

8. The electrically conductive container of claim 7 wherein said exterior electrically conductive portion of said container member comprises electrically conductive material adhered to said second surfaces of said sidewalls of said container member, and wherein said electrically conductive means comprises means for making electrical contact between said first and second surfaces of said sidewalls.

9. The electrically conductive container of claim 8 wherein said electrically conductive material comprises graphite impregnated paper laminated to said first and second surfaces of said sidewalls.

10. The electrically conductive container of claim 8 wherein said container member is formed from a substantially flat blank of cardboard material having electrically conductive material adhered to the opposite sides thereof, said blank of cardboard material being cut and folded to define said sidewalls and said bottom wall so that said first and second surfaces of said sidewalls are defined by respective first and second portions of said sides of said blank of cardboard material having said electrically conductive material adhered thereto and so that said first and second portions are in electrical contact with one another.

11. The electrically conductive container of claim 10 wherein said blank of cardboard material is cut and folded so that said respective first and second portions defining said first and second surfaces of said sidewalls are both on one of said opposite sides of said blank of cardboard material having said electrically conductive material adhered thereto, and wherein said means for making electrical contact comprises said electrically conductive material intermediate said first and second portions on said one side of said blank of cardboard material.

12. The electrically conductive container of claim 11 wherein said first surface of said bottom wall is in electrical contact with said first and second surfaces of said sidewalls and with said second surface of said bottom wall.

13. The electrically conductive container of claim 12 wherein said bottom wall is formed from said blank of cardboard material so that said second surface of said bottom wall is defined on said one side of said blank and so that said first surface of said bottom wall is defined on the other side of said blank.

14. The electrically conductive container of claim 13 further including folding members formed from said blank of cardboard material, said folding members being folded and cut from said blank so that electrically conductive material on said one side of said blank is in electrical contact with electrically conductive material on said other side of said blank.

15. The electrically conductive container of claim 8 further including a cover member for said container member to provide a substantially closed interior of said container member, said cover member including an interior wall surface for defining with said sidewalls and said bottom wall said interior of said container member, and including an exterior wall surface.

16. The electrically conductive container of claim 15 wherein said cover member includes electrically conductive material on at least one of said interior and exterior wall surfaces, and wherein said bottom wall of said container member includes electrically conductive material on at least one surface thereof to provide a substantially enclosed interior of said container member which is surrounded by electrically conductive material.

17. The electrically conductive container of claim 16 wherein said electrically conductive material adhered to said cover member is adhered to said exterior wall surface of said cover member.

18. The electrically conductive container of claim 17 wherein said electrically conductive material adhered to said exterior wall surface of said cover member is in electrical contact with said electrically conductive material on said second surfaces of said sidewalls of said container member when said cover member is placed on said container member.

19. The electrically conductive container of claim 18 wherein said container member is formed from a first blank of cardboard material having electrically conductive material adhered to the opposite sides thereof, said first blank of cardboard material being cut and folded to define said sidewalls and said bottom wall so that said first and second surfaces of said sidewalls are defined by respective first and second portions of said sides of said blank of cardboard material having said electrically conductive material adhered thereto and so that said first and second portions are in electrical contact with one another.

20. The electrically conductive container of claim 17 wherein said cover member is formed from a second blank of cardboard material having electrically conductive material adhered to the opposite sides thereof, and wherein said second blank is folded so that respective portions of said sides of said second blank having electrically conductive material adhered thereto are in electrical contact with one another.

21. The electrically conductive container of claim 1 further including at least one divider wall member in said interior of said container member, said divider wall member being disposed in a pair of oppositely disposed slots of said holding panels, and said divider wall member including an electrically conductive holding means in electrical contact with said exterior electrically conductive portion of said exterior wall surface and said electrically conductive holding means having slots therein which cooperate with oppositely disposed slots in said holding panels arranged on said interior wall portion of said container member to form additional holding pockets for positively receiving and holding said objects.

* * * * *